US011466581B1

(12) United States Patent
Snider et al.

(10) Patent No.: US 11,466,581 B1
(45) Date of Patent: Oct. 11, 2022

(54) TURBINE NOZZLE ASSEMBLY SYSTEM WITH NOZZLE SETS HAVING DIFFERENT THROAT AREAS

(71) Applicant: General Electric Company, Schenectady, NY (US)

(72) Inventors: Zachary John Snider, Simpsonville, SC (US); Adam John Fredmonski, Simpsonville, SC (US); Matthew Troy Hafner, Honea Path, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/323,354

(22) Filed: May 18, 2021

(51) Int. Cl.
*F01D 9/04* (2006.01)
*F01D 9/02* (2006.01)

(52) U.S. Cl.
CPC ..... *F01D 9/047* (2013.01); *F01D 9/02* (2013.01); *F05D 2220/30* (2013.01); *F05D 2230/60* (2013.01); *F05D 2230/70* (2013.01); *F05D 2240/128* (2013.01)

(58) Field of Classification Search
CPC ... F01D 9/02; F01D 9/04; F01D 9/041; F01D 9/047; F05D 2230/60; F05D 2230/70; F05D 2240/128
See application file for complete search history.

(56) References Cited

U.S. PATENT DOCUMENTS 6,789,315 B2 9/2004 Marques et al.
9,033,654 B2 5/2015 Peck et al.
10,655,482 B2 * 5/2020 Freeman ..... F01D 9/044

FOREIGN PATENT DOCUMENTS

EP 2055903 A2 5/2009

* cited by examiner

*Primary Examiner* — Christopher R Legendre
(74) *Attorney, Agent, or Firm* — Charlotte Wilson; James Pemrick; Hoffman Warnick LLC

(57) ABSTRACT

A turbine nozzle assembly system includes a plurality of nozzle sets, where each nozzle set forms an annulus. The nozzles in each set include an inner endwall and an outer endwall that include joint openings to receive the respective endwall mount ends of an airfoil. The airfoils across the plurality of nozzle sets have an inner endwall mount end and an outer endwall mount end that are identical amongst the plurality of nozzle sets. A wing portion of the airfoil has a selected wing shape that is identical within the respective nozzle set but different amongst the plurality of nozzle sets. In this manner, the endwalls can be removed from an airfoil and replaced with an airfoil having a different wing shape that provides a different pairwise throat area. The system allows changing of a pairwise throat area for a nozzle set without replacing the entirety of each nozzle.

12 Claims, 8 Drawing Sheets

TURBINE NOZZLE ASSEMBLY SYSTEM WITH NOZZLE SETS HAVING DIFFERENT THROAT AREAS

TECHNICAL FIELD

The disclosure relates generally to turbomachines and, more particularly, to a turbine nozzle assembly system with different nozzle sets having airfoils with wing portions that create different throat areas.

BACKGROUND

In a turbine, a number of stationary nozzles are arranged in an annulus to direct a working fluid towards a rotating blade stage. A working fluid, such as combustion gases or steam, is directed by the stationary vanes to impart rotation to the rotating blade stage to generate power. The pairwise throat area is an area between an inner endwall, an outer endwall and wing portions of adjacent nozzles. The pairwise throat area is typically selected to provide ideal turbine performance, for example, by directing the working fluid in a manner to impart the most power to the rotating blade stage. The pairwise throat area that provides the best turbine performance can change during operation of the turbine and can change over time as the turbine ages. It is therefore advantageous to periodically change the pairwise throat area of a turbine to improve or maintain performance levels.

One approach to change a pairwise throat area includes replacing an entire nozzle set, for example, during a periodic maintenance of a turbine. Current nozzle set replacement includes completely replacing each nozzle in the set including the endwalls and airfoil. This process is expensive because each new nozzle has to be built in its entirety. In another approach, variable nozzle assemblies allow minimal changes in geometry between wing portions to adjust the pairwise throat area, for example, by rotating the wing portions of the nozzles during operation of the turbine. Variable nozzle assemblies require complicated and expensive mechanical systems to allow for movement of the wing portions and to maintain sufficient mechanical strength for the working environment of the turbine. Further, variable nozzle assemblies can only provide a limited amount of adjustment, which may be insufficient to provide all desired throat area adjustments over a lifetime of a turbine.

BRIEF DESCRIPTION

All aspects, examples and features mentioned below can be combined in any technically possible way.

An aspect of the disclosure provides a turbine nozzle assembly system, comprising: a plurality of nozzle sets, each nozzle set including a plurality of nozzles that collectively form an annulus, each nozzle of a respective nozzle set including: an airfoil having: an inner endwall mount end that is identical to the inner endwall mount end amongst the plurality of nozzle sets, an outer endwall mount end that is identical to the outer endwall mount end amongst the plurality of nozzle sets, and a wing portion between the inner endwall mount end and the outer endwall mount end, wherein the wing portion has a wing shape selected from a plurality of wing shapes that are identical within the respective nozzle set but different amongst each of the plurality of nozzle sets, an inner endwall including a first joint opening configured to receive the inner endwall mount end of the airfoil; an outer endwall including a second joint opening configured to receive the outer endwall mount end of the airfoil; and wherein a pairwise throat area is created by the inner endwall, the outer endwall and the wing portions of adjacent airfoils in the annulus, and wherein each nozzle set of the plurality of nozzle sets provides a different pairwise throat area compared to each other nozzle set of the plurality of nozzle sets.

Another aspect of the disclosure includes any of the preceding aspects, and the outer endwall is mounted to the outer endwall mount end of the airfoil by a first fillet, and the inner endwall is mounted to the inner endwall mount end of the airfoil by a second fillet.

Another aspect of the disclosure includes any of the preceding aspects, and at least one of the outer endwall mount end and the inner endwall mount end further includes a cooling passage therein, the cooling passage positioned adjacent at least a portion of the respective first or second fillet.

Another aspect of the disclosure includes any of the preceding aspects, and the cooling passage includes a radially facing inlet.

Another aspect of the disclosure includes any of the preceding aspects, and the inlet is adjacent a leading edge of the wing portion of the airfoil.

Another aspect of the disclosure includes any of the preceding aspects, and further comprising a trailing edge cooling passage in the wing portion and in fluid communication with the cooling passage, the trailing edge cooling passage including a plurality of passages exiting a trailing edge of the wing portion of the airfoil.

Another aspect of the disclosure includes any of the preceding aspects, and the cooling passage includes a radially facing inlet, and an outlet facing into an interior cooling chamber of the airfoil.

Another aspect of the disclosure includes any of the preceding aspects, and further comprising a plurality of cooling passages within the at least one of the outer endwall mount end and the inner endwall mount end.

Another aspect of the disclosure includes any of the preceding aspects, and each of the plurality of wing shapes that are different amongst the plurality of nozzle sets has a similar radius of curvature distribution at each of a plurality of spanwise cross-sectional locations.

Another aspect relates to a method, comprising: for each nozzle in a first nozzle set including a plurality of nozzles that collectively form an annulus, removing an inner endwall mount end of a first wing portion of a first airfoil from an inner endwall of the nozzle and removing an outer endwall mount end of the first wing portion of the first airfoil from an outer endwall of the nozzle, each first wing portion having a first wing shape providing a first pairwise throat area with wing portions of adjacent first airfoils of the first nozzle set; and for each nozzle in a second nozzle set, coupling an inner endwall mount end of a second wing portion of a second airfoil of the second nozzle set to the inner endwall and coupling an outer endwall mount end of the second wing portion of the second airfoil to the outer endwall, each second wing portion having a second wing shape providing a second pairwise throat area with adjacent wing portions of adjacent second airfoils in the second nozzle set, wherein the second pairwise throat area of the second nozzle set is different than the first pairwise throat area of the first nozzle set, wherein the inner endwall mount end of the first wing portion and the second wing portion are identical, and the outer endwall mount end of the first wing portion and the second wing portion are identical.

Another aspect of the disclosure includes any of the preceding aspects, and coupling the outer endwall to the outer endwall mount end of the second wing portion includes brazing to create a first fillet; and wherein the coupling the inner endwall to the inner endwall mount end of the second wing portion includes brazing to create a second fillet.

Another aspect of the disclosure includes any of the preceding aspects, and the first and second wing portions have a similar radius of curvature distribution at each of a plurality of spanwise cross-sectional locations between the inner endwall mount end and the outer endwall mount end.

Two or more aspects described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
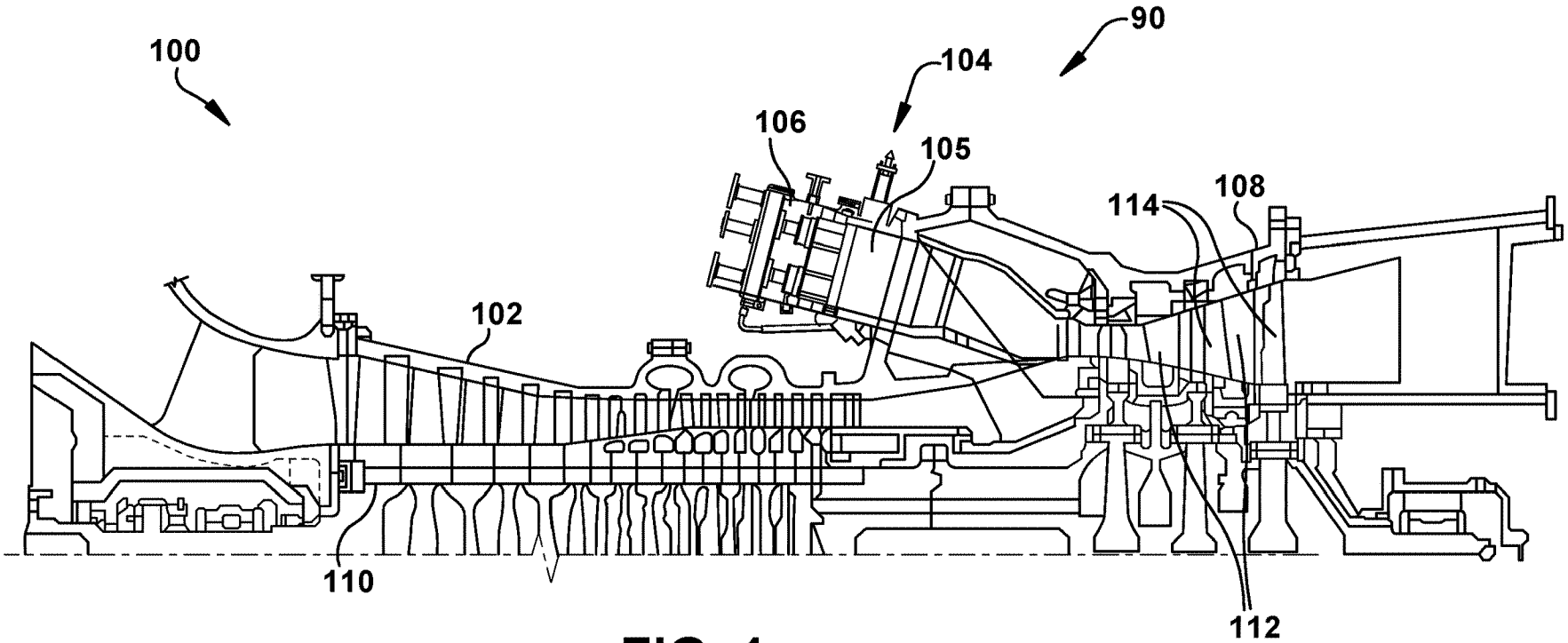
FIG. 1 shows a schematic view of an illustrative turbomachine.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the current technology, it will become necessary to select certain terminology when referring to and describing relevant machine components within a turbomachine. To the extent possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine and by turbine blades, or, for example, the flow of air through the combustor or coolant through one of the turbine's component systems. The term "downstream" corresponds to the direction of flow of the fluid, and the term "upstream" refers to the direction opposite to the flow. Components, such as airfoils, positioned within the flow of fluids through a gas turbine may be described as having a "leading edge," which is the foremost edge of the component that first encounters the oncoming flow of fluids, and a "trailing edge" opposite the leading edge. The terms "forward" and "aft," without any further specificity, refer to directions, with "forward" referring to the front or compressor end of the engine, and "aft" referring to the rearward or turbine end of the engine.

It is often required to describe parts that are disposed at different radial positions with regard to a center axis. The term "radial" refers to movement or position perpendicular to an axis. For example, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to an axis A, e.g., rotor shaft 110. Finally, the term "circumferential" refers to movement or position around an axis. It will be appreciated that such terms may be applied in relation to the center axis of the turbine.

In addition, several descriptive terms may be used regularly herein, as described below. The terms "first," "second," and "third" may be used interchangeably to distinguish one component from another and are not intended to signify location or importance of the individual components.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof. "Optional" or "optionally" means that the subsequently described event or circumstance may or may not occur and that the description includes instances where the event occurs and instances where it does not.

Where an element or layer is referred to as being "on," "engaged to," "connected to," or "coupled to" another element or layer, it may be directly on, engaged to, connected to or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

As used herein, the term "identical" relative to parts indicates the intent to have the parts (or portions thereof) have the same design and manufacturing specifications. For example, the mountends of nozzles from different nozzle sets are intended to be exactly the same—identical. However, as-made mount end dimensions may be slightly different because of manufacturing tolerances, yet both nozzle ends would still fit satisfactorily within the corresponding endwall mount. Thus, "identical" may be construed as "retro-fittable" or "also fits."

Various aspects of the disclosure are directed toward a turbine nozzle assembly system that includes a plurality of nozzle sets. Each nozzle set includes a plurality of nozzles that collectively form a circumferential ring or annulus, i.e., of a nozzle stage in a turbomachine. The nozzles in each set include an inner endwall including a first joint opening configured to receive an inner endwall mount end of an airfoil, and an outer endwall including a second joint opening configured to receive the outer endwall mount end of the airfoil. The airfoils of the nozzles have an inner endwall mount end and an outer endwall mount end that are identical amongst the plurality of nozzle sets, so any of them can be used with the same inner and outer endwall.

A wing portion of the airfoil between the inner endwall mount end and the outer endwall mount end has a wing shape selected from a plurality of wing shapes that are identical within the respective nozzle set but different amongst each of the plurality of nozzle sets. A pairwise throat area is created by the inner endwall, the outer endwall and the wing portions of adjacent airfoils in the annulus. Rather than replace an entire nozzle to change the throat area, for each nozzle in a given nozzle set, the endwalls can be removed from the original airfoil, and the original airfoil can be replaced with an airfoil having a different wing shape. The replacement airfoil may provide a different pairwise throat area and thus a different overall throat area for the nozzle set. That is, each nozzle set of the plurality of nozzle sets provides a different wing shape that provides a different throat area (pairwise and overall) compared to each other nozzle set of the plurality of nozzle sets. The system allows changing of an overall throat area for a nozzle stage without replacing the entirety of each nozzle—only the airfoil is changed. The system is less expensive to implement than an adjustable vane system or a total replacement of all nozzles within a nozzle stage.

Referring to the drawings, FIG. 1 is a schematic view of an illustrative turbomachine 90 in the form of a combustion turbine or gas turbine (GT) system 100 (hereinafter "GT system 100"), which may be used for electrical power generation. GT system 100 includes a compressor 102 and a combustor 104. Combustor 104 includes a combustion region 105 and a fuel nozzle assembly 106. GT system 100 also includes a turbine 108 and a common rotor shaft 110 (hereinafter referred to as "rotor shaft 110").

In one non-limiting embodiment, GT system 100 may be a 9F.05 engine, commercially available from General Electric Company, Greenville, S.C. However, the present disclosure is not limited to any one particular GT system and may be implemented in connection with other engines including, for example, other F, HA, B, LM, GT, TM and E-class engine models of General Electric Company, and engine models of other companies. Further, the teachings of the disclosure are not necessarily applicable to only a GT system and may be applied to other types of turbomachines, e.g., steam turbines, jet engines, compressors, etc.

Figure 2:
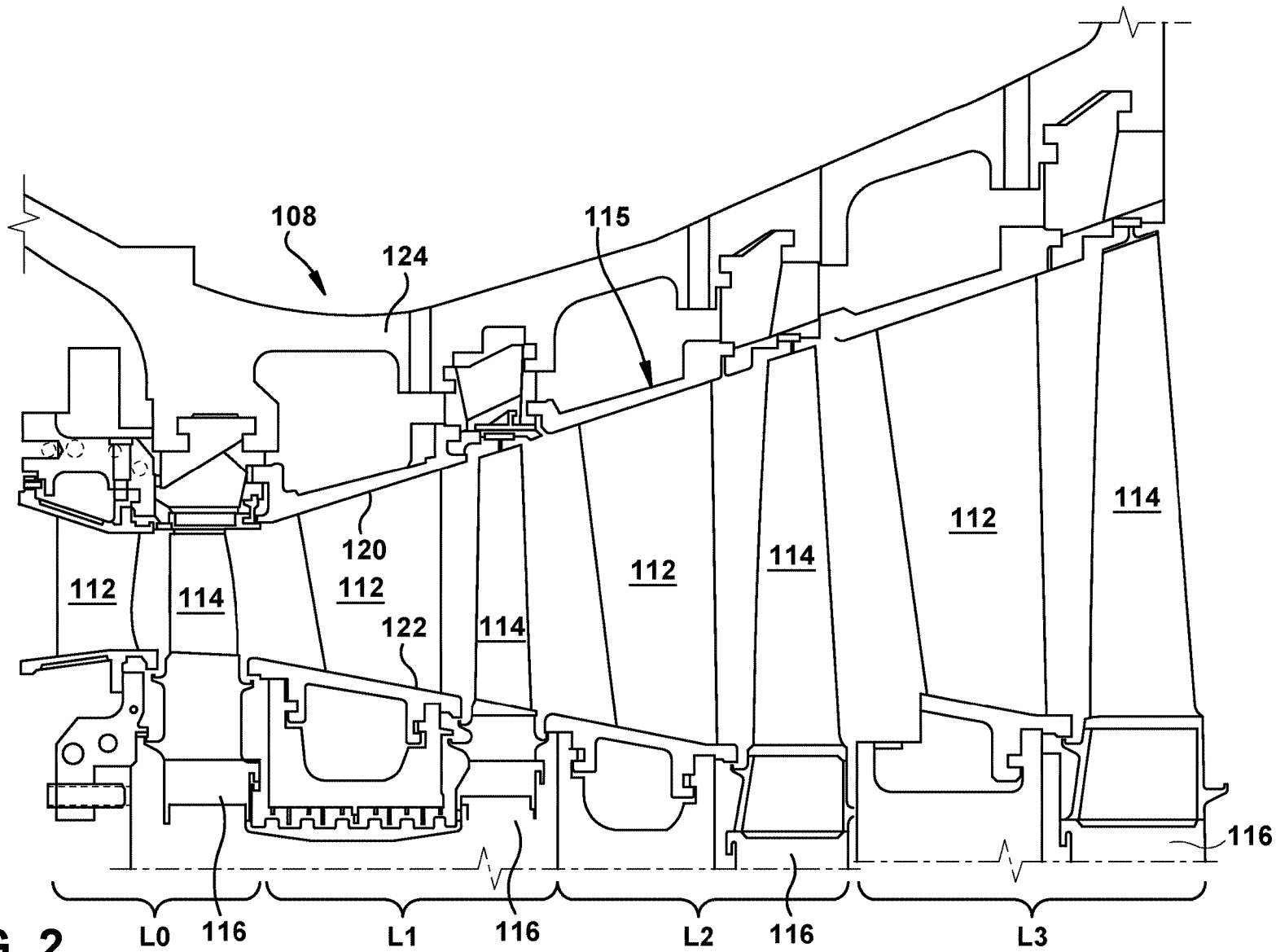
FIG. 2 shows a cross-sectional view of an illustrative gas turbine assembly with a four-stage turbine that may be used with the turbomachine in FIG. 1.

FIG. 2 shows a cross-section view of an illustrative portion of turbine 108 with four stages L0-L3 that may be used with GT system 100 in FIG. 1. The four stages are referred to as L0, L1, L2, and L3. Stage L0 is the first stage and is the smallest (in a radial direction) of the four stages. Stage L1 is the second stage and is the next stage in an axial direction, which is adjacent to and downstream of stage L0. Stage L2 is the third stage and is the next stage in an axial direction, which is adjacent and downstream of stage L1. Stage L3 is the fourth, last stage and is the largest (in a radial direction). It is to be understood that four stages are shown as one non-limiting example only, and each turbine 108 may have more or less than four stages.

A set of stationary nozzles 115 includes a plurality of nozzles 112 that collectively form a circumferential ring or annulus for a particular stage of turbine 108. That is, set of nozzles 115 includes stationary nozzles 112 circumferentially spaced around rotor shaft 110. Nozzle sets 115 cooperate with respective sets of rotating blades 114 to form each stage L0-L3 of turbine 108 and to define a portion of a flow path through turbine 108. Rotating blades 114 in each set are coupled to a respective rotor wheel 116 that couples them circumferentially to rotor shaft 110 (FIG. 1). That is, a plurality of rotating blades 114 is mechanically coupled in a circumferentially spaced manner to each rotor wheel 116. As will be described in greater detail herein, each nozzle 112 may include outer and inner endwalls (or platforms) 120, 122. In the example shown, nozzle 112 includes a radially outer endwall 120 and a radially inner endwall 122. Radially outer endwall 120 couples nozzle 112 to a casing 124 of turbine 108.

Referring to FIGS. 1-2, in operation, air flows through compressor 102, and compressed air is supplied to combustor 104. Specifically, the compressed air is supplied to fuel nozzle assembly 106 that is integral to combustor 104. Fuel nozzle assembly 106 is in flow communication with combustion region 105. Fuel nozzle assembly 106 is also in flow communication with a fuel source (not shown in FIG. 1) and channels fuel and air to combustion region 105. Combustor 104 ignites and combusts fuel. Combustor 104 is in flow communication with turbine 108 within which gas stream thermal energy is converted to mechanical rotational energy. Turbine 108 is rotatably coupled to and drives rotor shaft 110. Compressor 102 may also be rotatably coupled to rotor shaft 110. In the illustrative embodiment, there are a plurality of combustors 104 and fuel nozzle assemblies 106. In the following discussion, unless otherwise indicated, only one of each component will be discussed. At least one end of rotating rotor shaft 110 may extend axially away from either compressor 102 or turbine 108 and may be attached to a load or machinery (not shown), such as, but not limited to, a generator, a load compressor, and/or another turbine.

Figure 3:
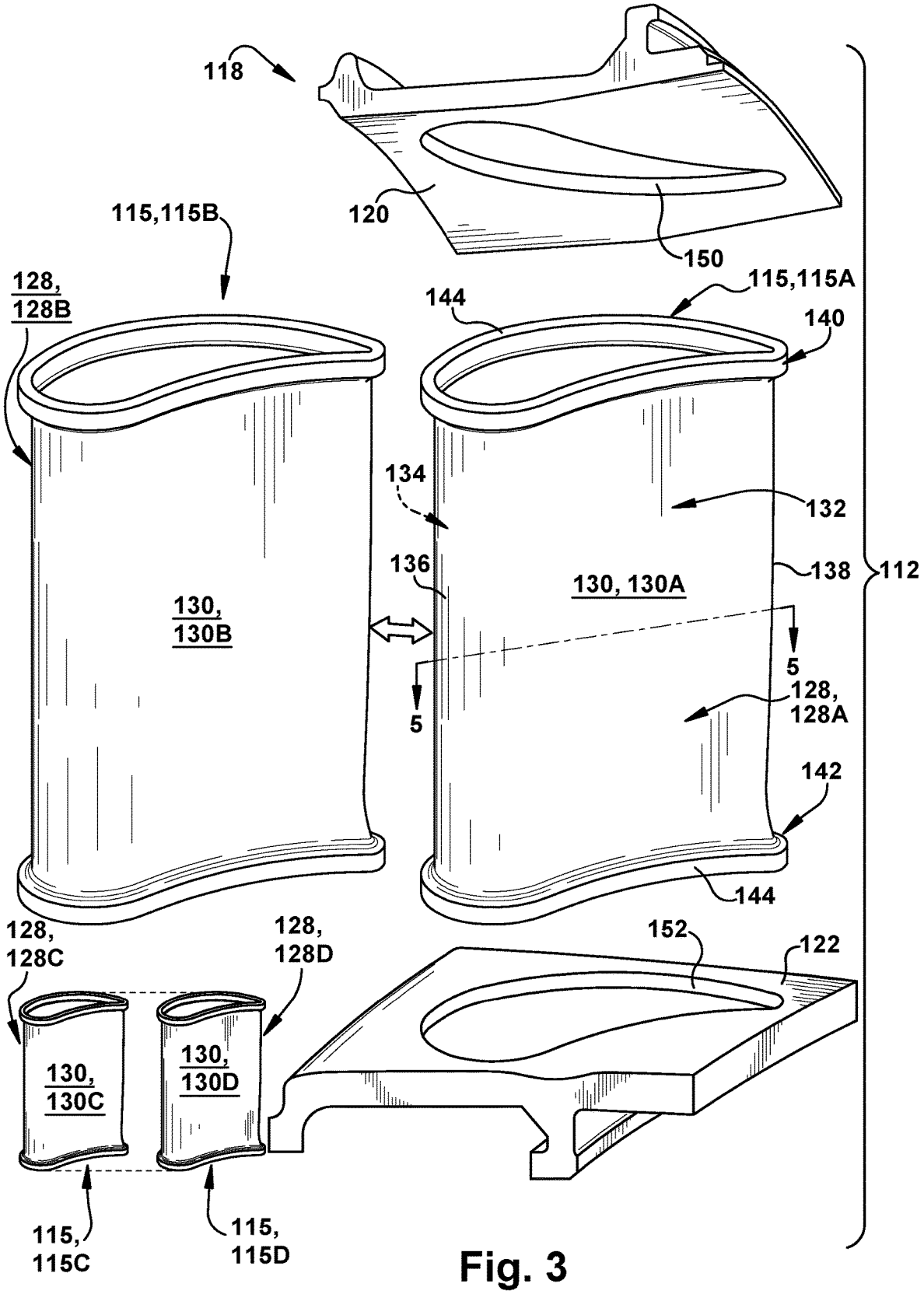
FIG. 3 shows a schematic and expanded three-dimensional view of a turbine nozzle assembly system including a nozzle, according to embodiments of the disclosure.
Figure 4:
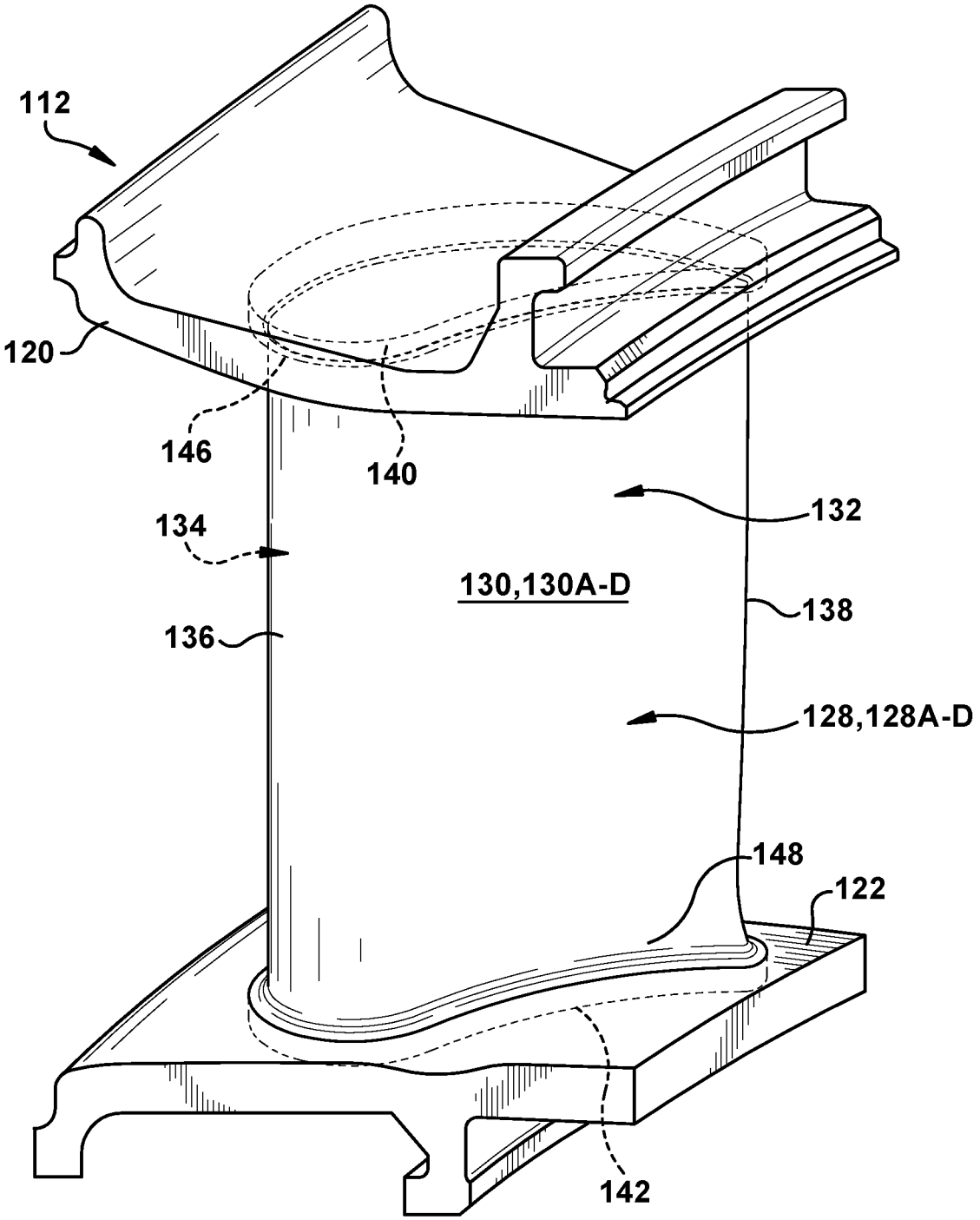
FIG. 4 shows a schematic three-dimensional view of an illustrative nozzle, according to embodiments of the disclosure.

FIG. 3 shows a schematic and expanded three-dimensional view of a turbine nozzle assembly system 118 (hereinafter "system 118") including a nozzle 112. FIG. 4 shows a schematic three-dimensional view of an illustrative nozzle 112 in an assembled form, according to embodiments of the disclosure. FIG. 3 also includes an exploded view of nozzle 112 in FIG. 4. As described above, system 118 includes a plurality of nozzle sets 115. For purposes of description, four nozzle sets 115A-D are schematically illustrated in FIG. 3 as being typified by airfoils 128A-D, respectively. However, any number of sets can be provided. Each nozzle set 115A-D is shown schematically as typified by different airfoils 128A-D, respectively, with each airfoil having a different wing portion 130A-D. Each nozzle set 115A-D includes a plurality of nozzles 112 that collectively form a circumferential ring or annulus for a stage L0-L3 (FIG. 2) of turbine 108 (FIG. 2).

As noted, during operation of turbine 108 (FIG. 1), nozzles 112 will remain stationary in order to direct the flow of working fluid (e.g., gas or steam) to one or more movable blades (e.g., blades 114), causing those movable blades to initiate rotation of rotor shaft 110. It is understood that nozzle 112 may be configured to couple (mechanically couple via fasteners, welds, slot/grooves, etc.) with a plurality of similar or distinct nozzles (e.g., nozzles 112 or other nozzles) to form an annulus of nozzles in a stage L0-L3 (FIG. 2) of turbine 108 (FIG. 2).

According to embodiments of the disclosure, each nozzle set 115A-D of the plurality of nozzle sets 115 provides a different pairwise throat area compared to each other nozzle set of the plurality of nozzle sets. Consequently, each nozzle set 115 also has a different overall throat area, i.e., the sum of all pairwise throat areas in the nozzle set. The different pairwise throat area is created by using airfoils 128A-D having identical inner endwall mount ends 142 and identical outer endwall mount ends 140, but different wing portions 130A-D between mount ends 140, 142.

As shown in FIGS. 3-4, each nozzle 112 can include an airfoil 128 having a wing portion 130. Wing portion 130 has a concave pressure side 132 and (obstructed in FIGS. 3-4) an opposing convex suction side 134. Wing portion 130 can also include a leading edge 136 spanning between pressure side 132 and suction side 134, and a trailing edge 138 opposing leading edge 136 and spanning between pressure side 132 and suction side 134.

As shown in FIG. 3, airfoil 130 also includes an outer endwall mount end 140 for coupling airfoil 128 to outer endwall 120. Nozzle sets 115A-D may have identical outer endwall mount ends 140, i.e., outer endwall mount ends 140 are identical amongst plurality of nozzle sets 115A-D. Airfoil 128 also includes an inner endwall mount end 142 for coupling airfoil 128 to inner endwall 122. Nozzle sets 115A-D may have identical inner endwall mount ends 142, i.e., inner endwall mount ends 142 are identical amongst the plurality of nozzle sets 115A-D. Mount ends 140, 142 may include any structure capable of coupling to endwalls 120, 122, e.g., by brazing. In one example, mount ends 140, 142 each include a rim member 144 that forms respective ends of wing portion 130. Mount ends 140, 142 extend a relatively small portion of a radial height of airfoil 128, e.g., 1-2% each.

As previously noted, and as shown best in FIG. 4, nozzle 112 can also include outer endwall 120 and inner endwall 122 connected with airfoil 128 along suction side 134, pressure side 132, leading edge 136, and trailing edge 138. Outer endwalls 120 are configured to align on the radially outer side of nozzle set 115 (FIG. 2) and to couple respective nozzle(s) 112 to casing 124 (FIG. 2) of turbine 108 (FIG. 2). As shown in FIG. 3, outer endwall 120 includes a joint opening 150 configured to receive outer endwall mount end 140 of airfoil 128. Inner endwalls 122 are configured to align on the radially inner side of nozzle set 115 (FIG. 2). As shown in FIG. 3, inner endwall 122 includes a joint opening 152 configured to receive inner endwall mount end 142 of airfoil 128. Each joint opening 150, 152 is configured to receive the respective mount end 140, 142 by being sized and shaped to allow receipt of mount ends 140, 142 therein in a manner allowing joining, e.g., by welding or brazing.

In various embodiments, shown in FIG. 4, each nozzle 112 includes a fillet 146, 148 connecting airfoil 128 and each respective endwall 120, 122. That is, outer endwall 120 is mounted to outer endwall mount end 140 (FIG. 3) of airfoil 128 by a fillet 146, and inner endwall 122 is mounted to inner endwall mount end 142 (FIG. 3) of airfoil 128 by a fillet 148. Fillets 146, 148 can include a weld or braze fillet creating a joint, which may be formed via conventional metal-inert gas (MIG) welding, tungsten-inert gas (TIG) welding, brazing, etc. As shown best in FIG. 6, fillets 146, 148 can overlap a portion of airfoil 128. The extent of overlap can vary from nozzle to nozzle, stage to stage, and/or turbine to turbine.

Figure 5:
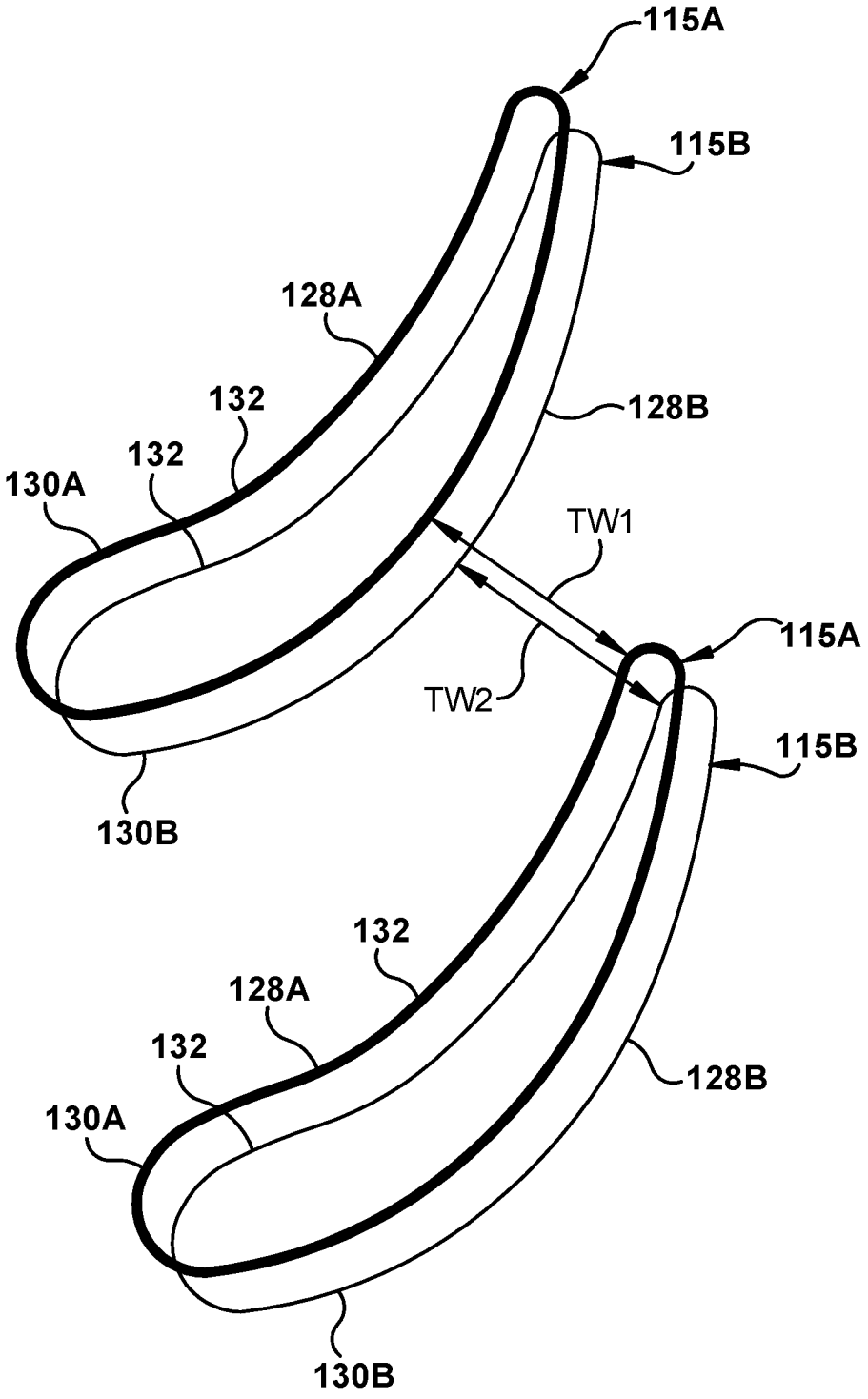
FIG. 5 shows a schematic cross-sectional view of two different sets of nozzles superimposed showing different pairwise throat areas, according to embodiments of the disclosure.

FIG. 5 shows a schematic cross-sectional view of two different sets of nozzles, e.g., 115A, 115B, superimposed to illustrate different pairwise throat areas, according to embodiments of the disclosure. The cross-sectional view of FIG. 5 may be taken, for example, along line 5-5 in FIG. 3, but may be at any spanwise cross-sectional location along wing portions 130 excepting mount ends 140, 142. A pairwise throat area is created by outer endwall 120, inner endwall 122 and wing portions 130 of adjacent airfoils 128 of the annulus of nozzles 112. Changing the pairwise throat area can change the overall throat area of the annulus of a particular nozzle set 115.

In FIG. 5, different pairwise throat areas are illustrated by different throat widths TW1, TW2 at a particular cross-section of wing portions 130 of airfoils 128A, 128B. Throat width may be defined as a minimum distance between adjacent airfoils 128A, 128B. In the example shown, throat width is illustrated between a trailing edge 138 of one airfoil and a closest point of convex suction side 134 of the other airfoil. However, throat width is not necessarily identified at those particular points in all instances. In any event, a throat width TW1 of wing portions 130A of airfoils 128A in nozzle set 115A is different than a throat width TW2 of wing portions 130B of airfoils 128B in nozzle set 115B (i.e., TW1≠TW2). The difference in throat width can occur at any number of spanwise cross-sectional locations of wing portions 130. In this manner, across a radial length of wing portions 130A-D of airfoils 128A-D, the wing portion can be shaped and sized to create a wide variation in pairwise throat area for adjacent airfoils 128A-D in a particular nozzle set 115A-D.

Of note, because mount ends 140, 142 of each airfoil 128 are identical regardless of airfoil 128 in which employed, any airfoil 128A-D that provides a different wing portion 130 with a different pairwise throat area can be mounted to outer and inner endwall 120, 122. In this manner, only airfoils 128 need to be changed to adjust a pairwise throat area of a nozzle set 115, i.e., for a stage of turbine 108 (FIG. 2). Any number of nozzle sets 115 can be created as part of system 118 to allow for replacement of an airfoil 128A having a first pairwise throat area with another airfoil, e.g., 128B, C or D, having a second, different pairwise throat area.

With further reference to FIG. 5, while different pairwise throat areas are provided by wing portions 130A-B of different airfoils 128A-B, each of the plurality of wing shapes that are different amongst the plurality of nozzle sets 115A-D (FIG. 3) may have a similar, or re-optimized, radius of curvature distribution at each of a plurality of spanwise cross-sectional locations. That is, while a throat width changes between adjacent airfoils, each airfoil 128 can have a similar radius of curvature distribution if that is desirable for the application, e.g., within 5% of the previous radius of curvature. In this manner, the aerodynamic performance of a nozzle set 115A-D (FIG. 3) created by a wing shape for a wing portion 130 is maintained despite the changing of airfoils 128.

Referring to FIGS. 3 and 4, a method according to embodiments of the disclosure will be described. As shown in FIG. 3, for each nozzle in first nozzle set 115A including a plurality of nozzles 112 that collectively form a circumferential ring or annulus, i.e., of a stage L0-L3 (FIG. 2), inner endwall mount end 142 of first wing portion 130A of first airfoil 128A may be removed from inner endwall 122 of nozzle 112. Similarly, outer endwall mount end 140 of first wing portion 130A of first airfoil 128A may be removed from outer endwall 120 of nozzle 112. As noted, each first wing portion 130A has a first wing shape providing a first pairwise throat area with wing portions of adjacent first airfoils 130A of first nozzle set 115A. Endwalls 120, 122 may be removed using any now known or later developed technique, e.g., heating to melt fillets 146, 148, cutting and then removing remnants of airfoil 130A, etc.

Inner endwall mount ends 142 of first wing portion 130A and a selected second wing portion 130B, C or D are identical, and outer endwall mount ends 140 of first wing portion 130A and second wing portion 130B, C or D are identical. As a result, any of airfoils 128A-D can be readily substituted for one another to change a pairwise throat area of the set of nozzles.

Embodiments of the method may continue, as shown in FIG. 4, with coupling inner endwall mount end 142 of a replacement, or second, airfoil 128B, C or D (of a second nozzle set 115B, C or D) to inner endwall 122. The method may further include coupling outer endwall mount end 140 of the respective second airfoil 128B, C, or D to outer endwall 120. This process can be repeated for each nozzle in a nozzle set 115. As explained relative to FIG. 5, each second wing portion 130 (e.g., 130B) has a second wing shape providing a second pairwise throat area with adjacent wing portions 130B of adjacent second airfoils 128B in second nozzle set 115B. The second pairwise throat area of second nozzle set 115B is different from the first pairwise throat area of first nozzle set 115A. Likewise, the pairwise throat area of third nozzle set 115C and the pairwise throat area of fourth nozzle set 115D are each different from the first pairwise throat area of first nozzle set 115A and the second pairwise throat area of second nozzle set 115B.

The coupling of outer endwall 120 to outer endwall mount end 140 of second wing portion 130B may include, for example, brazing to create first fillet 146 (FIG. 4). Similarly, coupling inner endwall 120 to inner endwall mount end 142 of second wing portion 130B may include, for example, brazing to create a second fillet 148 (FIG. 4). As noted, first and second wing portions 130A, 130B may have a similar radius of curvature distribution at each of a plurality of spanwise cross-sectional locations between inner endwall mount end 142 and outer endwall mount end 140, e.g., within 5% of the previous radius of curvature.

Figure 6:
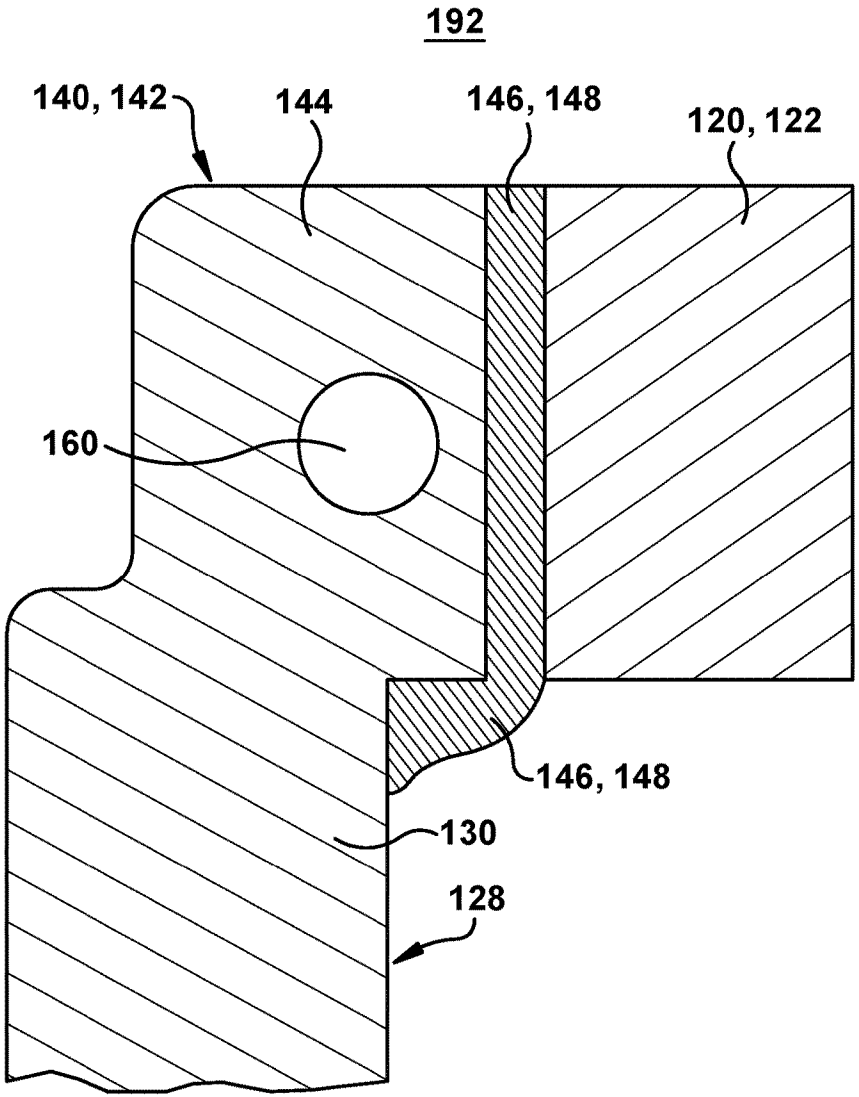
FIG. 6 shows a schematic cross-sectional view of a rim member of an endwall mount end of a nozzle airfoil including a cooling passage, according to embodiments of the disclosure.

Referring to FIGS. 6-10, alternative embodiments of nozzle 112 are illustrated. In various embodiments, nozzle 112 may include one or more cooling passages 160 to cool, among other things, mount ends 140, 142 of airfoil 128. More particularly, at least one of outer endwall mount end 140 and inner endwall mount end 142 may further include a cooling passage 160. FIG. 6 shows a schematic cross-sectional view of a rim member 144 of mount end 140 or 142 within respective inner or outer endwalls 120 or 122. As shown, regardless of mount end 140, 142, cooling passage 160 may be positioned adjacent at least a portion of respective first or second fillet 146, 148. In this manner, a coolant passing through cooling passage 160 can cool rim member 144, fillet 146 or 148, and/or inner or outer endwall 120, 122.

Figure 7:
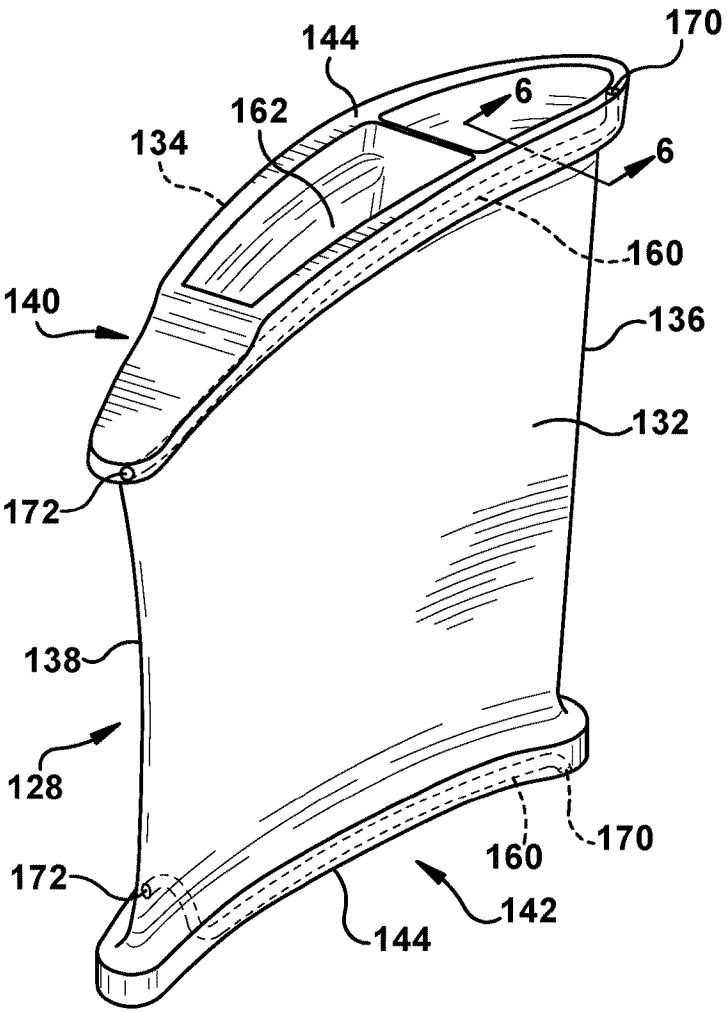
FIG. 7 shows a rear perspective view of a nozzle airfoil with inner and outer endwalls removed and with a cooling passage therein, according to embodiments of the disclosure.

Cooling passage 160 may extend through nozzle 112 in a number of different ways to deliver coolant, where desired. FIG. 7 shows a rear perspective view of airfoil 128 with inner and outer endwalls removed. Here, cooling passage 160 passes lengthwise through rim members 144 of outer and inner endwall mount ends 140, 142, e.g., along pressure side 132 of wing portion 130 of airfoil 128. (FIG. 7 also shows view line 6-6 of FIG. 6.) Coolant may exit cooling passage(s) 160 through outlets 172 in rim members 144 near trailing edge 138 of wing portion 130. In other embodiments, cooling passage 160 may be provided in only one of rim members 144, i.e., rim member 144 of either mount end 140 or 142, but not both.

Figure 8:
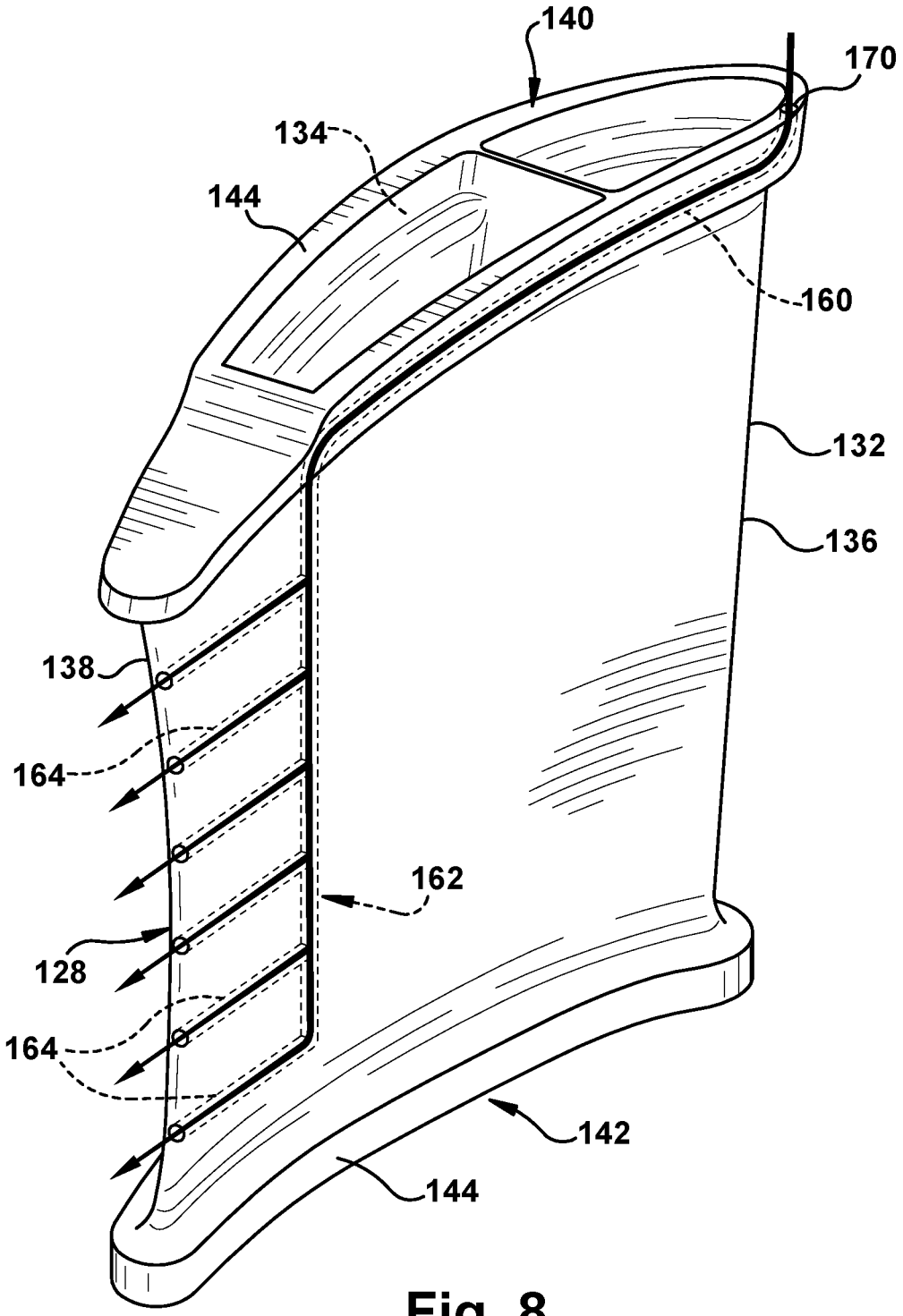
FIG. 8 shows a rear perspective view of a nozzle airfoil with inner and outer endwalls removed and with a cooling passage therein, according to other embodiments of the disclosure.

FIG. 8 shows a rear perspective view of airfoil 128 according to other embodiments of the disclosure. FIG. 8 shows a nozzle 112 with inner and outer endwalls 122, 120 (FIG. 6) removed. Here, cooling passage 160 passes lengthwise through part of one rim member 144 (e.g., of outer endwall mount end 140), and along part of pressure side 132 of wing portion 130 of airfoil 128. Nozzle 112 also includes a trailing edge cooling passage 162 in wing portion 130 and in fluid communication with cooling passage 160. Trailing edge cooling passage 162 may include a plurality of passages 164 exiting trailing edge 138 of wing portion 130 of airfoil 128. Any number of passages 164 may be used. Coolant can thus enter cooling passage 160 near leading edge 136, pass along pressure side 132 in rim member 144, and then exit through passages 164 in trailing edge 138. In either of the FIGS. 7 and 8 embodiments, cooling passage 160 may include a radially facing inlet(s) 170 through which coolant can enter cooling passage(s) 160. Inlet(s) 170 may be adjacent a leading edge 136 of wing portion 130 of airfoil 128. In this manner, coolant can enter the typically hotter region(s) of airfoil 128 and then pass towards relatively cooler regions of the airfoil to cool other parts.

Figure 9:
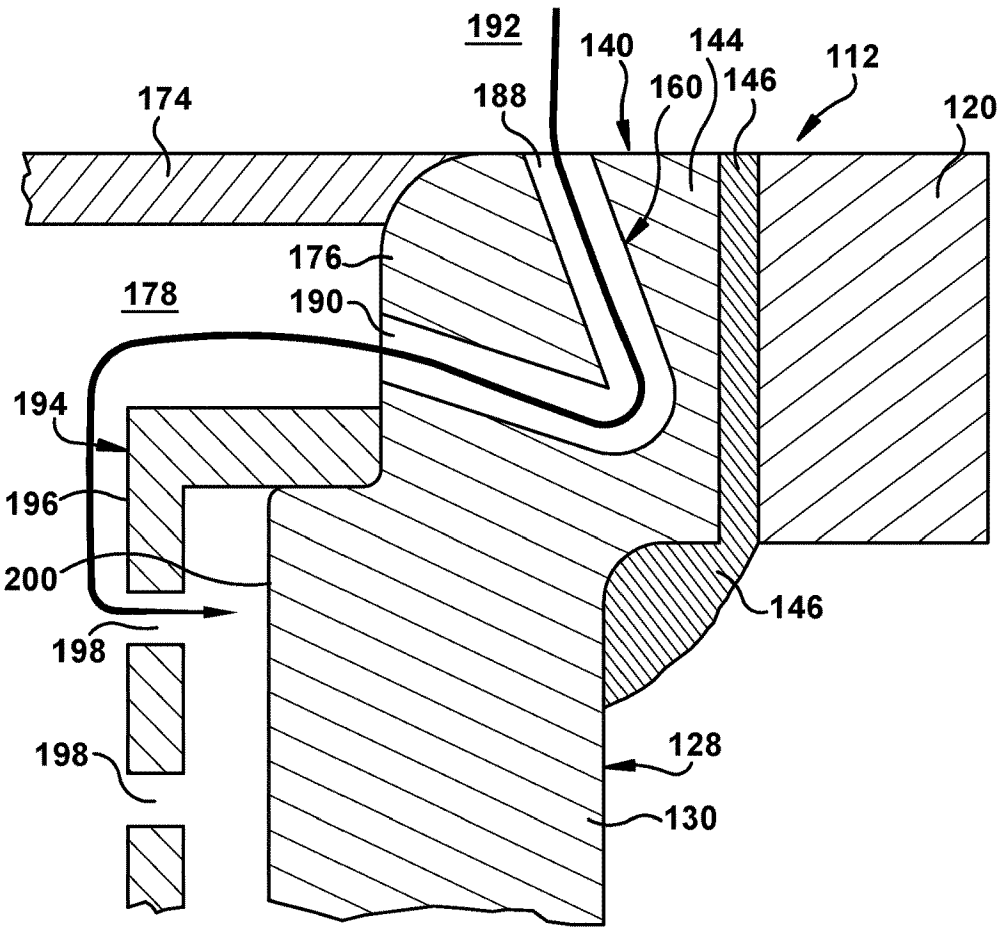
FIG. 9 shows a schematic cross-sectional view of a rim member of an endwall mount end of a nozzle airfoil including a cooling passage, according to other embodiments of the disclosure.

FIG. 9 shows a schematic cross-sectional view of a cooling passage 160, according to other embodiments of the disclosure. In FIG. 9, cooling passage 160 is in a rim member 144 of outer endwall mount end 140 within outer endwall 120. (Although not shown, it will be recognized that this cooling passage 160 arrangement can also be applied to rim member 144 of inner endwall mount end 142 within inner endwall 122.) A nozzle cap 174 is shown sealing a radial outer end 176 of a radially extending, interior cooling chamber 178 within wing portion 130 of airfoil 128. Here, cooling passage 160 includes a radially facing inlet 188 (facing radially outward in this example), and an outlet 190 facing into interior cooling chamber 178 of airfoil 128. Coolant can pass from an area 192 radially outside of outer endwall mount end 140 through rim member 144 thereof to cool rim member 144, fillet 146, and outer endwall 120. Subsequently, coolant enters interior cooling chamber 178 where it can be used to provide further cooling radially inward of rim member 140.

For example, although not necessary in all cases, an impingement cooling member 194 may be positioned within interior cooling chamber 178. Impingement cooling member 194 may include any now known or later developed impingement cooling structure such as a sleeve 196 with a plurality of openings 198 therein that allow coolant within interior cooling chamber 178 to exit and impinge on an inner surface 200 of wing portion 130 of airfoil 128. Coolant from interior cooling chamber 178, including coolant from cooling chamber 160, can impinge inner surface 200 to cool wing portion 130.

Figure 10:
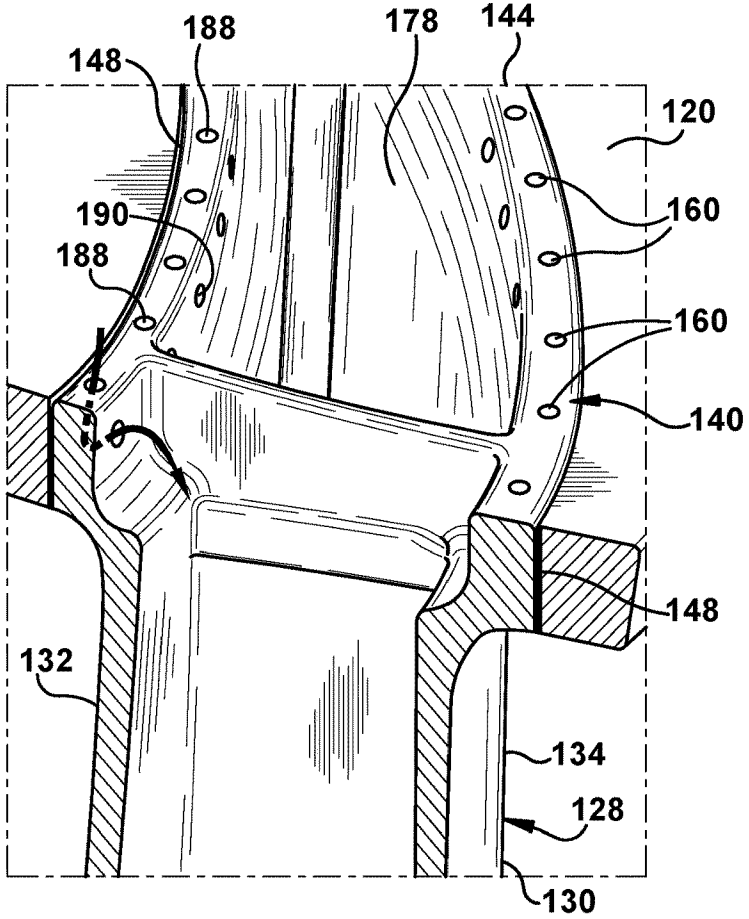
FIG. 10 shows a perspective, partial cross-sectional view of an outer endwall mount end of a nozzle including a plurality of cooling passages, according to embodiments of the disclosure.

FIG. 10 shows a perspective, partial cross-sectional view of outer endwall mount end 140 of nozzle 112 including a plurality of cooling passages 160 from FIG. 9. Cooling passages 160 can be arranged within rim member 144 of outer endwall mount end 140 in any manner, e.g., spaced evenly, located where hot spots are expected, etc. As illustrated, any number of cooling passages 160, as shown in FIG. 9, may be positioned about rim member 144 of outer endwall mount end 140.

Coolant can be provided to cooling passage(s) 160 from any now known or later developed coolant source. For example, for a radially outer end, coolant can be provided from area 192 (FIGS. 6 and 9), which is within casing 124 (FIG. 2) and is filled with compressed air, e.g., from compressor 102 (FIG. 1). In another example, for a radially inner end, coolant can be provided from an internal cooling chamber 178 of wing portion 130 of airfoil 128, or an internal wheel space (not shown) between stages of turbine 108.

While particular embodiments of cooling passage(s) 160 have been provided herein, embodiments of the disclosure can include any variety of cooling passage now known or later developed for nozzles. It will be recognized that with replacement of airfoils 128, cooling passages 160 can be provided that are the same as in the original airfoils, or the cooling passages 160 can be adjusted from the original airfoil to improve, for example, cooling, turbine performance and nozzle longevity.

Embodiments of the disclosure provide a system that allows for adjusting of a throat area (i.e., pairwise throat area and overall throat area) of a set of nozzles of a turbine without the expense of replacing the entirety of each nozzle in the set. In this manner, aerodynamic performance of a turbine 108 can be maintained or improved despite the aging of the turbine. The different airfoils have the same mount ends 140, 142 that allow coupling to used endwalls 120, 122, thus eliminating the need to replace the endwalls. Thus, system 118 allows airfoils 128 to be made separately, e.g., by casting or additive manufacture, from endwalls 120, 122, which is easier and less expensive than forming a one-piece nozzle and replacing each nozzle in a set. Cooling passages 160 can be provided in the replacement airfoils to maintain or improve cooling.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately," as applied to a particular value of a range, applies to both end values and, unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application and to enable others of ordinary skill in the art to understand the disclosure for various embodiments with various modifications as are suited to the particular use contemplated.

What is claimed is:

1. A turbine nozzle assembly system, comprising:

a plurality of nozzle sets, each nozzle set including a plurality of nozzles that collectively form an annulus, each nozzle of a respective nozzle set including:

an airfoil having:

an inner endwall mount end, an outer endwall mount end, a wing portion between the inner endwall mount end and the outer endwall mount end;

an inner endwall including a first joint opening configured to receive the inner endwall mount end of the airfoil;

an outer endwall including a second joint opening configured to receive the outer endwall mount end of the airfoil; and wherein the inner endwall mount ends amongst the plurality of nozzle sets are identical to each other, and the outer endwall mount ends amongst the plurality of nozzle sets are identical to each other;

wherein the wing portions of a respective nozzle set of the plurality of nozzle sets have wing shapes that are identical to each other and different than wing shapes of the wing portions of the other nozzle sets of the plurality of nozzle sets;

wherein for each nozzle set: adjacent nozzles of the plurality of nozzles define a pairwise throat area created by the respective inner endwalls, the respective outer endwalls and the respective wing portions; and wherein the pairwise throat area of each nozzle set of the plurality of nozzle sets is different than the pairwise throat areas of the other nozzle sets of the plurality of nozzle sets.

2. The turbine nozzle assembly system of claim 1, wherein for each nozzle: the outer endwall is mounted to the outer endwall mount end of the airfoil by a first fillet, and the inner endwall is mounted to the inner endwall mount end of the airfoil by a second fillet.

3. The turbine nozzle assembly system of claim 2, wherein for each nozzle: at least one of the outer endwall mount end and the inner endwall mount end further includes a cooling passage therein, the cooling passage positioned adjacent at least a portion of the respective first or second fillet.

4. The turbine nozzle assembly system of claim 3, wherein for each nozzle: the cooling passage includes a radially facing inlet.

5. The turbine nozzle assembly system of claim 4, wherein for each nozzle: the inlet is adjacent a leading edge of the wing portion of the airfoil.

6. The turbine nozzle assembly system of claim 4, further comprising for each nozzle: a trailing edge cooling passage in the wing portion and in fluid communication with the cooling passage, the trailing edge cooling passage including a plurality of passages exiting a trailing edge of the wing portion of the airfoil.

7. The turbine nozzle assembly system of claim 1, wherein for each nozzle: the outer endwall mount end includes a cooling passage therein, wherein the cooling passage includes a radially facing inlet and an outlet facing into an interior cooling chamber of the airfoil.

8. The turbine nozzle assembly of claim 7, further comprising for each nozzle: a plurality of cooling passages within the outer endwall mount end.

9. The turbine nozzle assembly system of claim 1, wherein each of the plurality of wing shapes that are different amongst the plurality of nozzle sets has a similar radius of curvature distribution at each of a plurality of spanwise cross-sectional locations.

10. A method, comprising:

providing a plurality of nozzles forming an annulus, each nozzle comprising:

an inner endwall and an outer endwall, wherein the inner endwall is configured to receive an inner endwall mount end of a wing portion of an airfoil, and the outer endwall is configured to receive an outer endwall mount end of the wing portion of the airfoil;

for each nozzle of the plurality of nozzles in a first nozzle set: removing a first inner endwall mount end of a first wing portion of a first airfoil from the inner endwall and removing a first outer endwall mount end of the first wing portion of the first airfoil from the outer endwall;

each first wing portion having a first wing shape providing a first pairwise throat area with the first wing portions of adjacent ones of the first airfoils of the first nozzle set; and for each nozzle of the plurality of nozzles in a second nozzle set: coupling a second inner endwall mount end of a second wing portion of a second airfoil to the inner endwall and coupling a second outer endwall mount end of the second wing portion of the second airfoil to the outer endwall;

each second wing portion having a second wing shape providing a second pairwise throat area with the second wing portions of adjacent ones of the second airfoils of the second nozzle set;

wherein the second pairwise throat area of the second nozzle set is different than the first pairwise throat area of the first nozzle set, wherein the first inner endwall mount end of the first wing portions and the second inner endwall mount end of the second wing portions are identical, and wherein the first outer endwall mount end of the first wing portions and the second outer endwall mount end of the second wing portions are identical.

11. The method of claim 10, wherein for each nozzle of the second nozzle set: the coupling the outer endwall to the second outer endwall mount end of the second wing portion includes brazing to create a first fillet, and wherein the coupling the inner endwall to the second inner endwall mount end of the second wing portion includes brazing to create a second fillet.

12. The method of claim 10, wherein the first and second wing portions have a similar radius of curvature distribution at each of a plurality of spanwise cross-sectional locations between the respective inner endwall mount end and the respective outer endwall mount end.

* * * * *